US006581763B2

(12) United States Patent
Allgood et al.

(10) Patent No.: US 6,581,763 B2
(45) Date of Patent: Jun. 24, 2003

(54) PACKAGING SYSTEM FOR COILED GOODS

(75) Inventors: Charles D. Allgood, Arlington, TX (US); Richard King, Arlington, TX (US)

(73) Assignee: Olympic General Corporation, Reno, NV (US)

( * ) Notice: Subject to any disclaimer, the term of this patent is extended or adjusted under 35 U.S.C. 154(b) by 0 days.

(21) Appl. No.: 10/007,500

(22) Filed: Oct. 18, 2001

(65) Prior Publication Data

US 2003/0075459 A1 Apr. 24, 2003

(51) Int. Cl.[7] ..... B65D 85/04

(52) U.S. Cl. ..... 206/54; 206/53; 206/389; 52/102; 53/430

(58) Field of Search ..... 206/53, 54, 389, 206/397, 390; 52/102; 53/409, 413, 430

(56) References Cited

U.S. PATENT DOCUMENTS

| | | | | | |
|---|---|---|---|---|---|
| 1,316,041 | A | * | 9/1919 | Johnson | 206/389 |
| 4,037,718 | A | * | 7/1977 | Stiller | 206/53 |
| 4,572,370 | A | * | 2/1986 | Cedenblad et al. | 206/398 |
| 4,984,689 | A | * | 1/1991 | Emalfarb et al. | 206/499 |
| 5,519,970 | A | * | 5/1996 | Reum et al. | 52/102 |
| 6,135,282 | A | * | 10/2000 | Tandon et al. | 206/395 |

FOREIGN PATENT DOCUMENTS

DE 39 17 239 A1 * 11/1990

* cited by examiner

*Primary Examiner*—David T. Fidei
(74) *Attorney, Agent, or Firm*—Michael A. O'Neil

(57) ABSTRACT

In a packaging system for coiled goods, a length of flexible material is wound into a coil. A hole is extended diametrically through the coil and a rod is extended through the hole. Fasteners are secured to the opposite end of the rod to secure the flexible material in the coiled configuration.

29 Claims, 4 Drawing Sheets

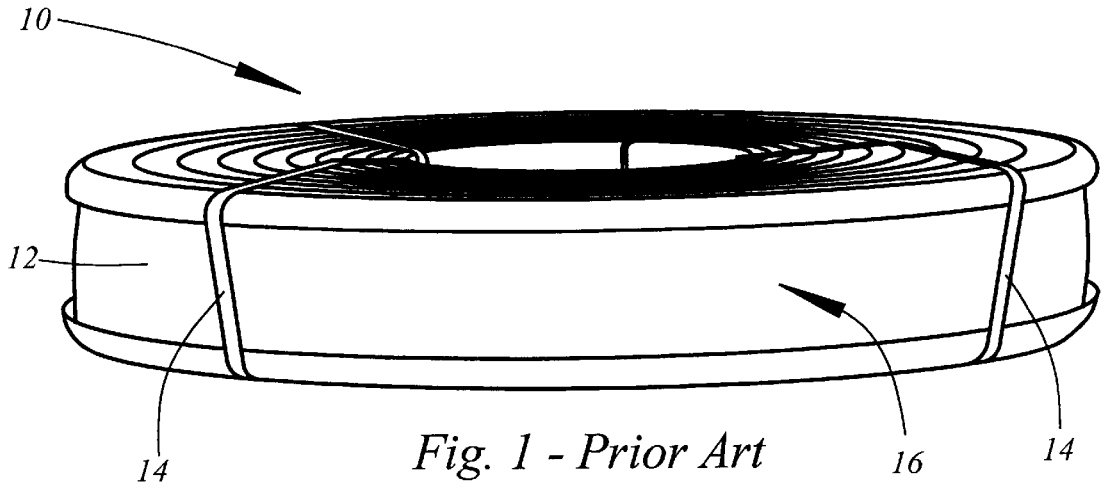
Fig. 1 - Prior Art
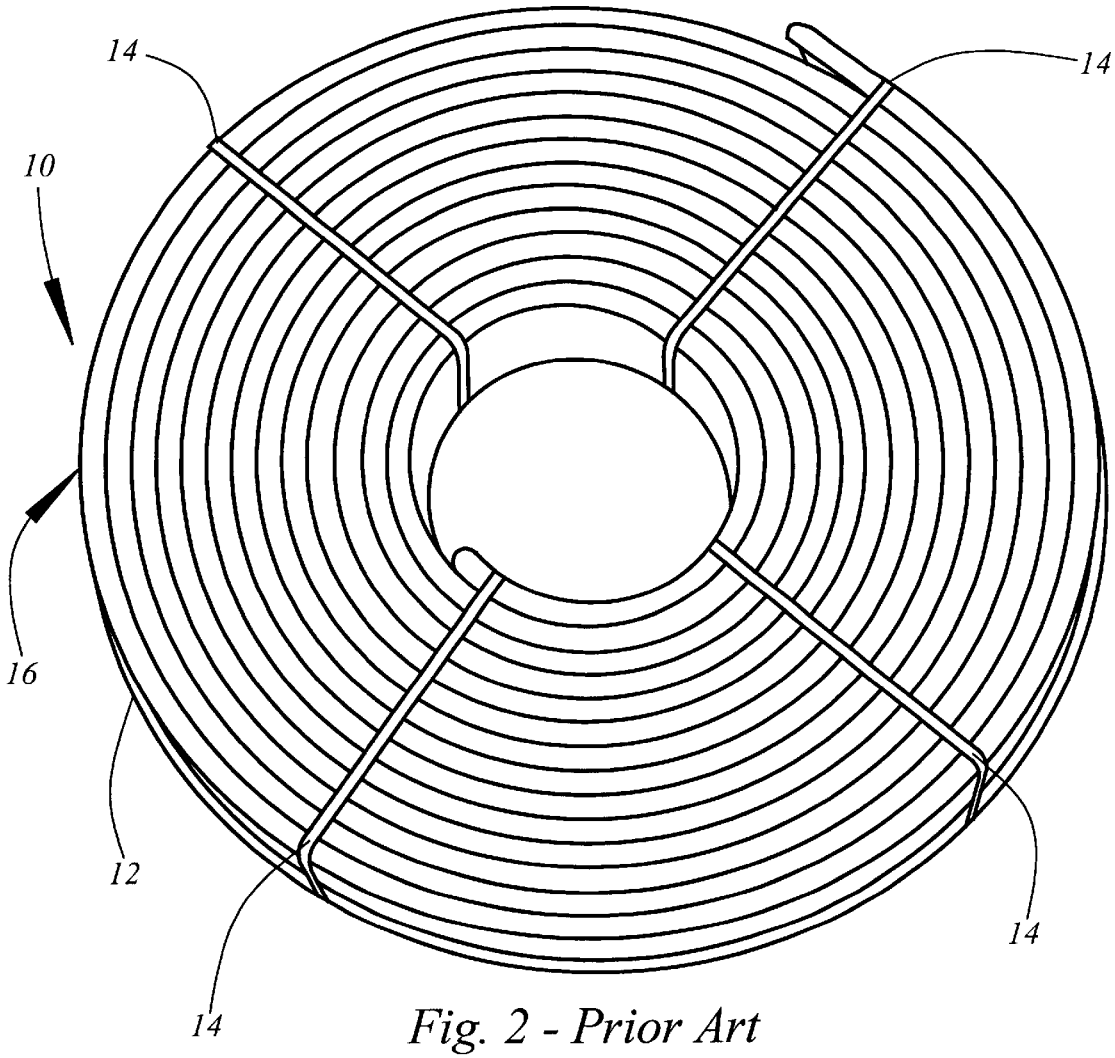
Fig. 2 - Prior Art

PACKAGING SYSTEM FOR COILED GOODS

TECHNICAL FIELD

This invention relates generally to packaging system for coiled goods such as plastic lawn edging and similar products, and more particularly to a system which retains such products in the coiled configuration while facilitating transportation thereof by the consumer.

BACKGROUND AND SUMMARY OF THE INVENTION

Plastic lawn edging and similar products are typically wound into a coiled configuration to facilitate transportation from the manufacturer to the retailer, pre-sale storage, display, and transportation by the purchaser from the retailer to the location at which the product will be utilized. Heretofore such products have been retained in the coiled configuration by lengths of strapping which are tightly secured around the coil at multiple locations around its circumference. The strapping technique functions well insofar as securing the product in the coiled configuration is concerned, but does not provide a handle to facilitate transportation of the coiled product from the retailer to the point of utilization.

As is well known, plastic lawn edging is almost universally marketed in the above-described coiled configuration. Plastic lawn edging typically comprises a lower spear-tipped edge adapted to secure the lawn edging into engagement with the earth, and an upper hollow cylindrical edge which is aesthetically pleasing and which provides a clear line of demarcation between the lawn and an adjacent garden. Adjacent lengths of plastic lawn edging are secured together by plastic tubing sections which are received in the hollow cylindrical upper edge of the lawn edging. Heretofore problems have been encountered because there has not been a reliable way to secure the connectors to the coiled plastic lawn edging prior to its utilization by the consumer.

The present invention comprises a packaging system for coiled goods which overcomes the foregoing and other problems which have long since been associated with the prior art. In accordance with the broader aspects of the invention, a length of product is wound into a coil. A hole is drilled diametrically through the multiple layers comprising the coiled product. A rod is extended through the hole from one side of the coiled product to the another, and fasteners are secured to both ends of the rod, thereby retaining the product in the coiled configuration. Lengths of strapping may be used to further secure the product in the coiled configuration, if desired.

In the case of plastic lawn edging and similar products, a connector for securing adjacent lengths of product end to end is located at the center of the coil and the rod which secures the product in the coiled configuration extends through the connector. This provides the dual benefit of affording a convenient handle for use in transportation of the product by the consumer and a convenient means of securing the connector to the coiled product and thereby assuring that it will not be lost or stolen.

BRIEF DESCRIPTION OF THE DRAWINGS

A more complete understanding of the invention may be had by reference to the following Detailed Description when taken in conjunction with the accompanying Drawings, wherein:

FIG. 1 is a perspective view illustrating a prior art system for securing products in a coiled configuration;

FIG. 2 is a top view of the product securing system illustrated in FIG. 1;

DETAILED DESCRIPTION

Referring to FIGS. 1 and 2, there is shown a prior art system 10 for securing elongate products in a coiled or spiral configuration. FIGS. 1 and 2 illustrate a length of plastic lawn edging 12 which is retained in a coiled or spiral configuration by four lengths of strapping material 14 thereby forming an assembly 16. The lengths of strapping material 14 are situated at more or less equally spaced intervals around the circumference of the coiled length of plastic lawn edging 12. The lengths of strapping material 14 are tightly wound around the coiled length of plastic lawn edging 12 and are effective in retaining the coiled length of plastic lawn edging 12 in the spiral configuration illustrated in FIGS. 1 and 2.

However, the lengths of strapping material 14 do not afford a convenient method for the consumer to carry the coiled length of plastic lawn edging 12 from the retailer to the location at which it will be used. Another difficulty which will be appreciated by those skilled in the art comprises the fact that the lengths of strapping material 14 do not afford a convenient means of securing the connectors which are used to connect adjacent ends of plastic lawn edging to the assembly 16 in such a way as to prevent loss or theft of the connectors.

Figure 3:
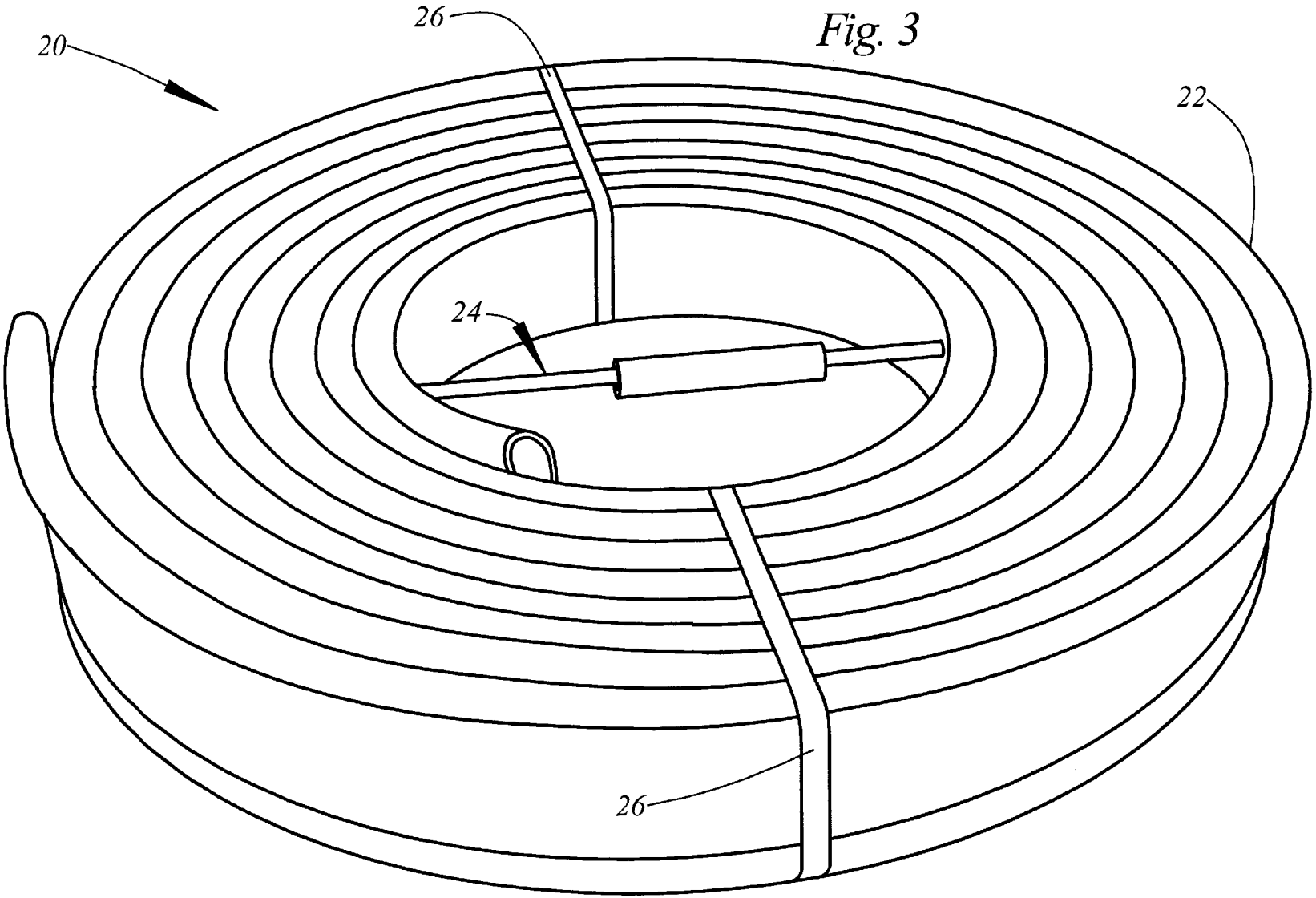
FIG. 3 is a top perspective view of a packaging system for coiled goods comprising the present invention.
Figure 4:
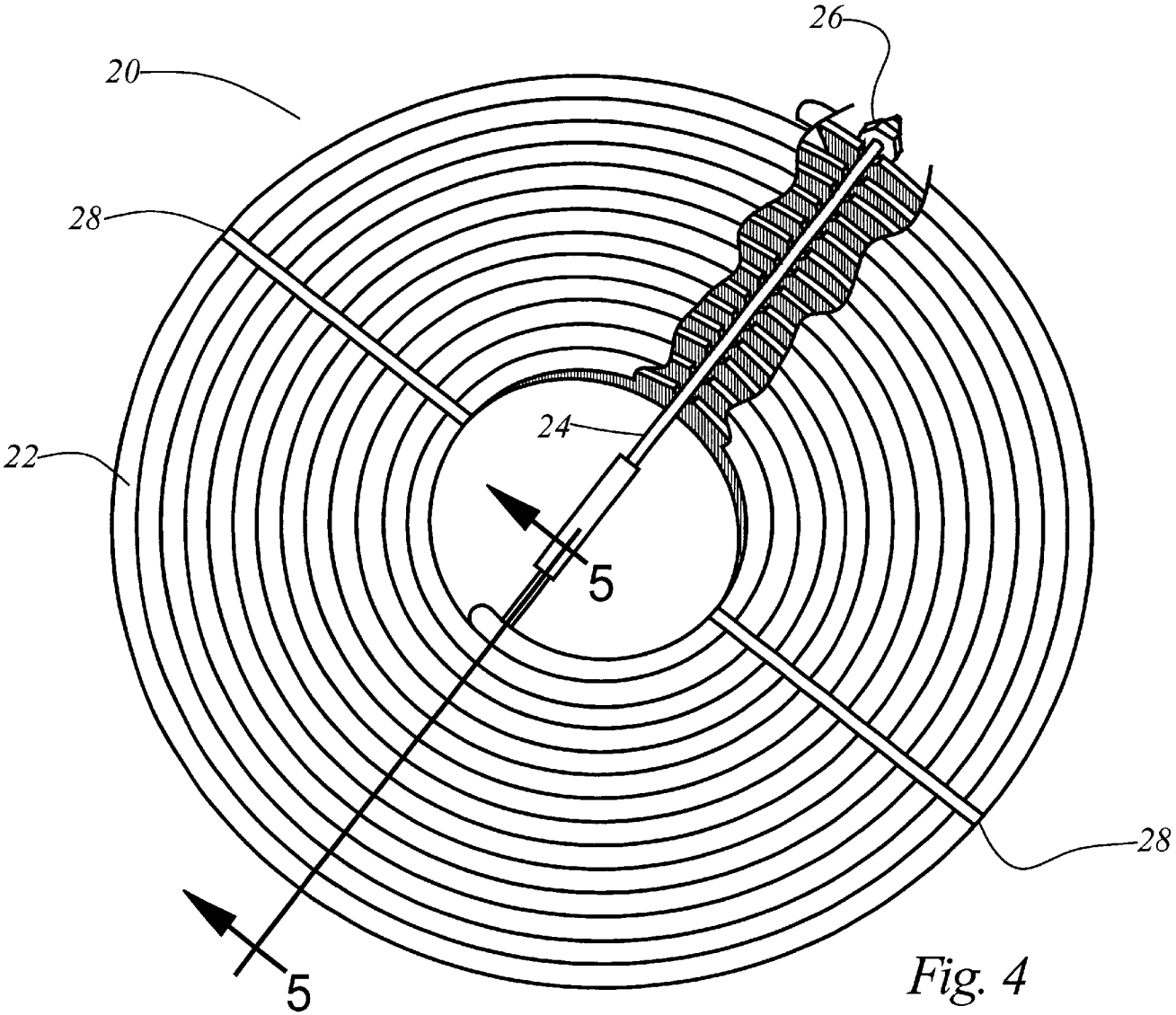
FIG. 4 is a top view of the system of FIG. 3 in which certain component parts have been broken away more clearly to illustrate certain features of the invention.

Referring to FIGS. 3 and 4, there is shown a packaging system for coiled goods 20 comprising the preferred embodiment of the present invention. In accordance with the invention, a length of flexible material 22 to be secured in a coiled or spiral configuration is first wound into the desired configuration as illustrated in FIGS. 3 and 4. Next, a hole is drilled diametrically through the spiral configuration of the flexible material 22. A rod 24 is extended through the drilled hole and fasteners 26 are secured to the opposite ends of the rod 24 to retain the flexible material 22 in the coiled or spiral configuration. Depending upon the nature of the flexible material 22 and the size of the coil thereof to be secured, lengths of strapping material 28 may be positioned at spaced locations relative to the rod 24 to further secure the flexible material in the coiled or spiral configuration.

Figure 5:
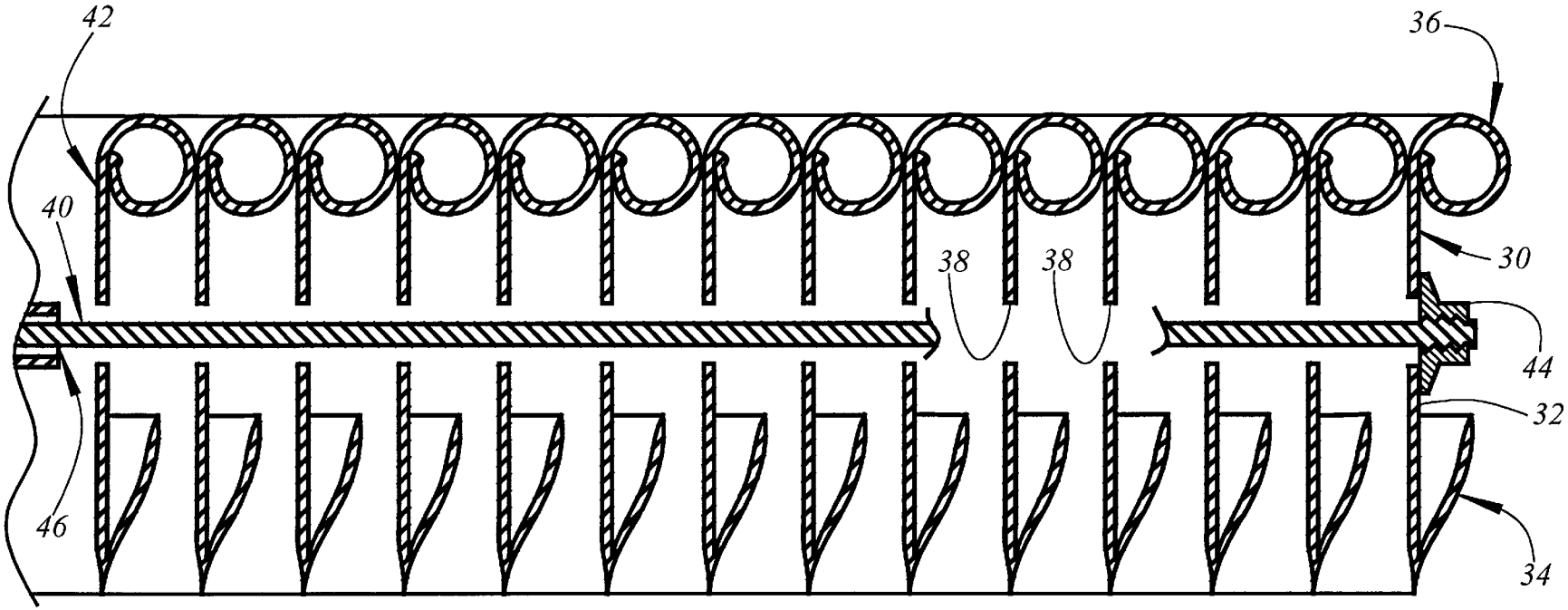
FIG. 5 is a sectional view taken along the line 5—5 in FIG. 4 in which certain parts have been broken away more clearly to illustrate certain features of the invention.

Referring particularly to FIG. 5, the present invention particularly adapted for use in securing coils of plastic lawn edging. A length of plastic lawn edging 30 comprises a web of plastic material 32 which is doubled back at one end to provide a spear-tipped configuration 34 that is useful in securing the plastic lawn edging in engagement with the earth. The opposite end the webbing 32 is coiled and secured to form a hollow cylinder. The cylindrical configuration is both aesthetically pleasing and serves as a clear line of demarcation between a lawn and an adjacent garden area.

A hole extending diametrically through the coil comprising the lawn edging 30 comprises a series of apertures 38 formed through the web 32 comprising each layer of the lawn edging 30 which makes up the spiral configuration thereof. A rod 40 extends through of the apertures 38 and through the center 42 of the coil comprising the lawn edging 30. Fasteners 44 are secured to the opposite ends of the rod 40 to secure the plastic lawn edging 30 into the coiled configuration. A handle 46 is positioned on the rod 40 within the opening 42. The handle 46 and the rod 40 facilitate transportation of the coil comprising the lawn edging 30 from a retailer to the location at which the lawn edging 30 will ultimately be used.

As will be appreciated by those skilled in the art, the rod 40 may have an enlarged portion at one thereof in which event only one fastener 44 is needed. The rod 40 may be formed from metal or plastic. Likewise, the fastener(s) may be formed from metal or plastic. The fastener(s) may be threaded or clipped into engagement with the rod 40. In accordance with the preferred embodiment of the invention, the rod 40 is formed from plastic and the fasteners are formed from metal. The fasteners are preferably of the type which are pressed into engagement with the rod and are threadedly disengaged therefrom.

The hollow cylindrical configuration 36 at one end of the web 32 of the plastic lawn edging 30 has a predetermined inside diameter. The handle 46 has a predetermined outside diameter which is closely matched to the inside diameter of the hollow cylindrical configuration 36. Prior to placing the lawn edging 30 in use, one or both of the fasteners 44 is removed and the rod 40 is withdrawn from the apertures 38, thereby releasing the handle 46. If two or more lengths of lawn edging 30 are utilized in a particular project, the handle 46 is inserted into the adjacent ends of the hollow cylindrical portions 36 of the two lengths of lawn edging, and thereafter serves as a connector which joins the two lengths of lawn edging 30 one to the other.

It will therefore be understood that in accordance with the present invention there is provided a packaging system for coiled goods which provides a convenient handle for use by the consumer in transporting the coiled goods from the retailer to the location of ultimate utilization. In the case of plastic lawn edging, the invention further comprises a cylindrical member which serves as a convenient handle while the lawn edging remains in the coiled configuration and as a connector for adjacent lengths of lawn edging when the lawn edging is placed in use.

Although preferred embodiments of the invention have been illustrated in the accompanying drawings and described in the foregoing Detailed Description, it will be understood that the invention is not limited to the embodiments disclosed but is capable of numerous rearrangements, modifications, and substitutions of parts and elements without departing from the spirit of the invention.

What is claimed is:

1. A packaging system for coiled goods comprising:

a length of flexible material wound into a coil;

a hole extending diametrically through the hole in the coil;

a rod extending through the hole in the coil; and means mounted at the opposite ends of the rod for retaining the flexible material in the coiled configuration.

2. The packaging system for coiled goods according to claim 1 wherein the retaining means comprises at least one fastener secured to one end of the rod.

3. The packaging system for coiled goods according to claim 2 wherein the rod and the fastener are formed from plastic.

4. The packaging system for coiled goods according to claim 2 wherein the rod and fastener are formed from metal.

5. The packaging system for coiled goods according to claim 2 wherein the rod is formed from plastic and the fastener is formed from metal.

6. The packaging system for coiled goods according to claim 2 wherein the rod is formed from metal and the fastener is formed from plastic.

7. The packaging system for coiled goods according to claim 1 wherein the coil of flexible material is further characterized by an open central portion, and further including a handle mounted on the rod and located within the open central portion of the coil.

8. The packaging system for coiled goods according to claim 7 wherein the length of flexible material is further characterized by an edge comprising a hollow cylindrical configuration having a predetermined inside diameter and wherein the handle comprises a cylindrical member having a predetermined outside diameter closely matched to the inside diameter of the hollow cylindrical edge of the flexible material whereby the handle serves as a connector for adjacent lengths of flexible material when in use.

9. The packaging system for coiled goods according to claim 1 wherein the length of flexible material comprises a length of plastic lawn edging of the type having an edge rolled into a hollow cylindrical configuration characterized by a predetermined diameter;

wherein the rod is formed from plastic;

wherein the retaining means comprises metal fasteners secured to the opposite end of the rod and further including a cylindrical handle mounted on the rod and characterized by a predetermined outside diameter matched to the inside diameter of the hollow cylindrical configuration of the plastic lawn edging so that the handle serves as a connector for adjacent lengths of lawn edging when in use.

10. The packaging system for coiled goods according to claim 9 wherein the fasteners are pressed into engagement with the rod and threaded disengaged therefrom.

11. A packaging system for coiled goods comprising:

a length of plastic lawn edging of the type comprising a plastic web having a spear-shaped configuration at one edge and a hollow cylindrical configuration having a predetermined diameter at the other edge;

said length of plastic lawn edging being wound into a coil;

a hole extending diametrically through the hole in the coil of plastic lawn edging;

a rod extending through the hole in the coil; and means mounted at the opposite ends of the rod for retaining the plastic lawn edging in the coil configuration.

12. The packaging system for coiled goods according to claim 11 wherein the retaining means comprises at least one fastener secured to one end of the rod.

13. The packaging system for coiled goods according to claim 12 wherein the rod and the fastener are formed from plastic.

14. The packaging system for coiled goods according to claim 12 wherein the rod and fastener are formed from metal.

15. The packaging system for coiled goods according to claim 12 wherein the rod is formed from plastic and the fastener is formed from metal.

16. The packaging system for coiled goods according to claim 12 wherein the rod is formed from metal and the fastener is formed from plastic.

17. The packaging system for coiled goods according to claim 1 wherein the coil of plastic lawn edging is further characterized by an open central portion, and further including a handle mounted on the rod and located within the open central portion of the coil.

18. The packaging system for coiled goods according to claim 17 wherein the handle has a cylindrical configuration and is characterized by a predetermined outside diameter which is closely matched to the inside diameter of the hollow cylindrical configuration whereby the handle serves as a connector for adjacent lengths of plastic lawn edging when in use.

19. A method of retaining flexible materials in a coiled configuration comprising the steps of:

providing a length of flexible material;

winding the length of flexible material into a coiled configuration;

forming a hole diametrically through the coil of flexible material thus formed;

providing a rod;

extending the rod through the hole in the coil of flexible material;

providing a pair of fasteners; and securing the fasteners on the opposite ends of the rod and thereby retaining the length of flexible material in the coiled configuration.

20. The method according to claim 19 wherein the step of providing a rod is carried out by providing a rod formed from plastic.

21. The method according to claim 19 wherein the step of providing a rod is carried out by providing a rod formed from metal.

22. The method according to claim 19 wherein the step of providing fasteners is carried out by providing fasteners formed from plastic.

23. The method according to claim 19 wherein the step of providing fasteners is carried out by providing fasteners formed from metal.

24. The method according to claim 19 wherein the step of providing a rod is carried out by providing a rod formed from plastic and wherein the step of providing fasteners is carried out by providing fasteners formed from metal.

25. The method according to claim 24 wherein the step of providing fasteners is further characterized by providing fasteners of the type adapted to be pressed into engagement with the rod threadingly disengaged therefrom.

26. The method according to claim 19 wherein the step of winding the flexible material into a coil is characterized by forming a coil of the type having an open center portion.

27. The method according to claim 26 further characterized by the steps of:

providing a handle;

positioning the handle within the open center portion of the coil; and extending the rod through the handle.

28. The method according to claim 27 wherein the step of providing the handle is further characterized by providing the handle having a cylindrical configuration and a predetermined outside diameter.

29. The method according to claim 28 wherein the step of providing a length of flexible material is further characterized by providing a length of flexible material having an edge rolled into a hollow cylindrical configuration characterized by an inside diameter which is closely matched to the outside diameter of the handle so that the handle serves as a connector for adjacent lengths of the flexible material when in use.

* * * * *